US009567196B2

(12) United States Patent
Horndacher et al.

(10) Patent No.: US 9,567,196 B2
(45) Date of Patent: Feb. 14, 2017

(54) ROPE HOIST WITH AN EMERGENCY BRAKING ARRANGEMENT

(75) Inventors: Norbert Horndacher, Ingelfingen (DE); Maria Ottilie Horndacher, legal representative, Ingelfingen (DE); Peter Kittsteiner, Waldenburg (DE); Ivica Zinic, Öhringen (DE)

(73) Assignee: R. Stahl Schaltgeräte GmbH, Waldenburg (DE)

( * ) Notice: Subject to any disclaimer, the term of this patent is extended or adjusted under 35 U.S.C. 154(b) by 616 days.

(21) Appl. No.: 13/581,161

(22) PCT Filed: Feb. 11, 2011

(86) PCT No.: PCT/IB2011/050583

§ 371 (c)(1),
(2), (4) Date: Apr. 25, 2014

(87) PCT Pub. No.: WO2011/104650

PCT Pub. Date: Feb. 1, 2011

(65) Prior Publication Data

US 2015/0014613 A1 Jan. 15, 2015

(30) Foreign Application Priority Data

Feb. 25, 2010 (DE) ..... 10 2010 009 357

(51) Int. Cl.
*B66D 5/34* (2006.01)
*B66D 1/40* (2006.01)

(52) U.S. Cl.
CPC .. *B66D 5/34* (2013.01); *B66D 1/40* (2013.01)

(58) Field of Classification Search
CPC ..... B66D 1/54; B66D 1/58; B66D 3/26; B66D 5/04; B66D 5/06; B66D 5/20; B66D 5/32; B66D 5/34
See application file for complete search history.

(56) References Cited

U.S. PATENT DOCUMENTS 2,745,633 A 5/1956 Cornwell
4,175,727 A * 11/1979 Clarke ..... B66D 5/26 192/12 R (Continued)

FOREIGN PATENT DOCUMENTS

DE 35 20 967 A1 12/1986
GB 2 015 461 A 9/1979

OTHER PUBLICATIONS

European Patent Office, International Search Report in the international Patent Application No. PCT/IB2011/050583 (Jun. 14, 2011).

*Primary Examiner* — Emmanuel M Marcelo
(74) *Attorney, Agent, or Firm* — Leydig, Voit & Mayer, Ltd.

(57) ABSTRACT

A cable hoist having an emergency braking arrangement comprising a dual toothed wheel assembly driven via a cable drum of the hoist. One of two toothed wheels of the toothed wheel assembly is sensed by a sensing lever of an anchor and an opposite end of the anchor interacts with a ratchet wheel of the toothed wheel assembly. As soon as an over speed occurs, the anchor engages in the ratchet wheel and causes a rotary movement of a carrier on which the anchor is mounted. This rotary motion is used to trigger a mechanical braking arrangement coupled to the cable drum.

13 Claims, 4 Drawing Sheets

(56) References Cited

U.S. PATENT DOCUMENTS

| | | | | | |
|---|---|---|---|---|---|
| 4,177,973 | A * | 12/1979 | Miller | B66D 1/54 | 188/170 |
| 4,448,290 | A * | 5/1984 | Reid, Jr. | B66D 1/54 | 188/184 |
| 4,493,479 | A * | 1/1985 | Clark | B66D 1/58 | 188/134 |
| 4,518,153 | A * | 5/1985 | West | B66D 1/54 | 188/166 |
| 5,513,723 | A * | 5/1996 | Luebke | B66B 5/04 | 187/244 |
| 5,653,312 | A * | 8/1997 | Kato | B66D 5/16 | 187/350 |
| 6,092,789 | A * | 7/2000 | Christopher | B66D 1/54 | 188/106 P |
| 6,144,307 | A * | 11/2000 | Elliot | B66D 1/58 | 340/665 |
| 2005/0072965 | A1* | 4/2005 | Sanders | B66D 1/485 | 254/361 |
| 2006/0186388 | A1* | 8/2006 | Thune | B66D 1/54 | 254/347 |
| 2010/0237306 | A1* | 9/2010 | Eschelbacher | B66D 1/12 | 254/362 |

* cited by examiner

ROPE HOIST WITH AN EMERGENCY BRAKING ARRANGEMENT

CROSS-REFERENCE TO RELATED APPLICATIONS

This patent application is the national phase of PCT/IB2011/050583, filed Feb. 11, 2011, which claims the benefit of German Patent Application No. DE 10 2010 009 357:2-22, filed Feb. 25, 2010, which is incorporated by reference.

FIELD OF THE INVENTION

The present invention relates generally to rope or cable hoists, and more particularly, to a cable hoist having an improved malfunction braking device.

BACKGROUND OF THE INVENTION

Cable or rope hoists comprise a cable drum to which one end of a traction cable is fastened. A gear motor is used to selectively rotate the cable drum in one or the other direction. The gear motor comprises a gearing mechanism as well as art asynchronous or a synchronous motor. Permanently excited direct current motors may also be used.

For safety reasons, a brake is also assigned to the cable drum, whereby the brake is to become enabled whenever a malfunction occurs in the drive train between the motor and the gearing mechanism. Such a malfunction may be, for example, the occurrence of a brake failure in the drive or a power failure in the motor. Synchronous and asynchronous motors do not have their own detent torque.

OBJECTS AND SUMMARY OF THE INVENTION

It is an object of the present invention to provide a cable hoist having an emergency braking arrangement that does not require electronics and operates with enhanced reliability.

The new cable hoist comprises a cable drum that is rotated via a gear motor and has an associated braking arrangement. Triggering of the braking arrangement is biased in a braking position, preferably by a spring which actuates the brake.

Generally, unintended crashing of a load results in an over speed of the cable drum, i.e., a rotational speed of the cable drum that is above the maximum rotational speed that can be achieved with the aid of the motor.

A control device is provided to detect this overspeed. The control device comprises a toothed wheel assembly consisting of a ratchet wheel and a driving wheel or polygonal wheel that are rotatably supported on a shaft, whereby the driving toothed wheel is coupled with the cable drum. Furthermore, an anchor carrier is located on the shaft of the two toothed wheels, said anchor carrier being able of performing at least one reciprocating movement about the rotational axis. An anchor is supported by the anchor carrier. One its one end, the anchor has a pawl and, on its other end, it has a sensing member. The pawl is intended to interact with the ratchet wheel, while the sensing member senses the driving toothed wheel.

Additionally, a clutch assembly is provided that connects the anchor carrier with the control device of the braking arrangement.

At low rotational speeds that deviate minimally from the maximum rotational speed of the cable drum in a normal operating mode, the sensing member of the anchor follows the curved structure of the driving toothed wheel. In doing so, the tooth tips are dimensioned in such a manner that, even if the sensing member moves over the tooth tips and remains in contact with said tips, the pawl remains out of engagement with the ratchet wheel. If the rotational speed of the cable drum increases, the rotational speed of the driving toothed wheel also increases. Due to the increased speed, the anchor is now accelerated more in the direction of engagement with the ratchet wheel and, consequently, lifts off the tip of the toothed wheel, its lift is large enough that the pawl will come into engagement with the ratchet wheel. Once the pawl has come into engagement with the ratchet wheel, with the appropriate geometric configuration of the ratchet wheel teeth, the teeth will safely mesh with each other, thus blocking a relative movement between the ratchet wheel and the anchor carrier. In doing so, the anchor carrier is moved along by the ratchet wheel in the direction of rotation. This movement about the axis on which the anchor carrier is supported is transmitted via a clutch assembly to the triggering mechanism of the braking arrangement, with the braking arrangement being triggered as a result.

The arrangement is very simple and functions without electronics. Consequently, interference with said arrangement is not possible, not even by external electrical noise fields. On the other hand, it is possible to prefabricate the control device as a module and couple it with any cable drum. It is not necessary to have the control device approved for each cable drum and for each cable hoist. One approval of the design and an adaptation to the respective cable drum is sufficient.

The driving toothed wheel for the anchor may have an at least approximately polygonal circumferential form. In this case, the phrase "at least approximately polygonal" is to also refer to such designs wherein the edges of the polygon extend concavely between the vertices in order to optionally generate a greater output force for the anchor.

In order to prevent mechanical damage in the case of a triggering situation, it may be effective to provide a slip friction clutch assembly that is kinematically arranged between the driving toothed wheel and the cable drum. This may be a friction clutch or an appropriately slipping belt.

A belt assembly, preferably a V-belt assembly, may be provided as a drive for the driving toothed wheel. This assembly comprises a V-belt pulley that is non-rotationally coupled with tile cable drum and a V-belt pulley that drives the driving toothed wheel. It is also possible to provide a toothed wheel connection.

The belt assembly is able to provide a transmission to a fast speed in such a manner that the driving toothed wheel rotates at a greater rotational speed than the cable drum. As a result of this, it is possible to achieve a particularly sensitive control response in tire sense that already very small overspeeds of the cable drum lead to a triggering of the emergency braking arrangement.

For frequency tuning of the movements of the anchor, it is possible to either use its mass (weight) or to use an arrangement wherein the anchor is biased by a spring that simultaneously holds the anchor out of engagement with the ratchet wheel.

The sensing member may comprise a sensing roller that is rotatably supported on a shaft of the anchor. As a result of this, sliding movements are precluded and the assembly becomes wear-resistant and smooth-running.

The clutch assembly between the control device and the braking arrangement may be a Bowden cable or a rod assembly.

The braking arrangement may comprise a brake drum or brake disk that is non-rotationally coupled with the cable drum and comprise at least one brake shoe or brake caliper.

According to a particularly simple embodiment, the brake drum may be a cylindrical extension of the cable drum with the brake shoe being in the form of a slit ring placed on the cable drum, and with the ring being biased at a prespecified radial force against this brake surface.

The braking arrangement further may comprise a locking device that can be locked by the brake shoe.

Other objects and advantages of the invention will become apparent upon reading the following detailed description and upon reference to the drawings.

Figure 1:
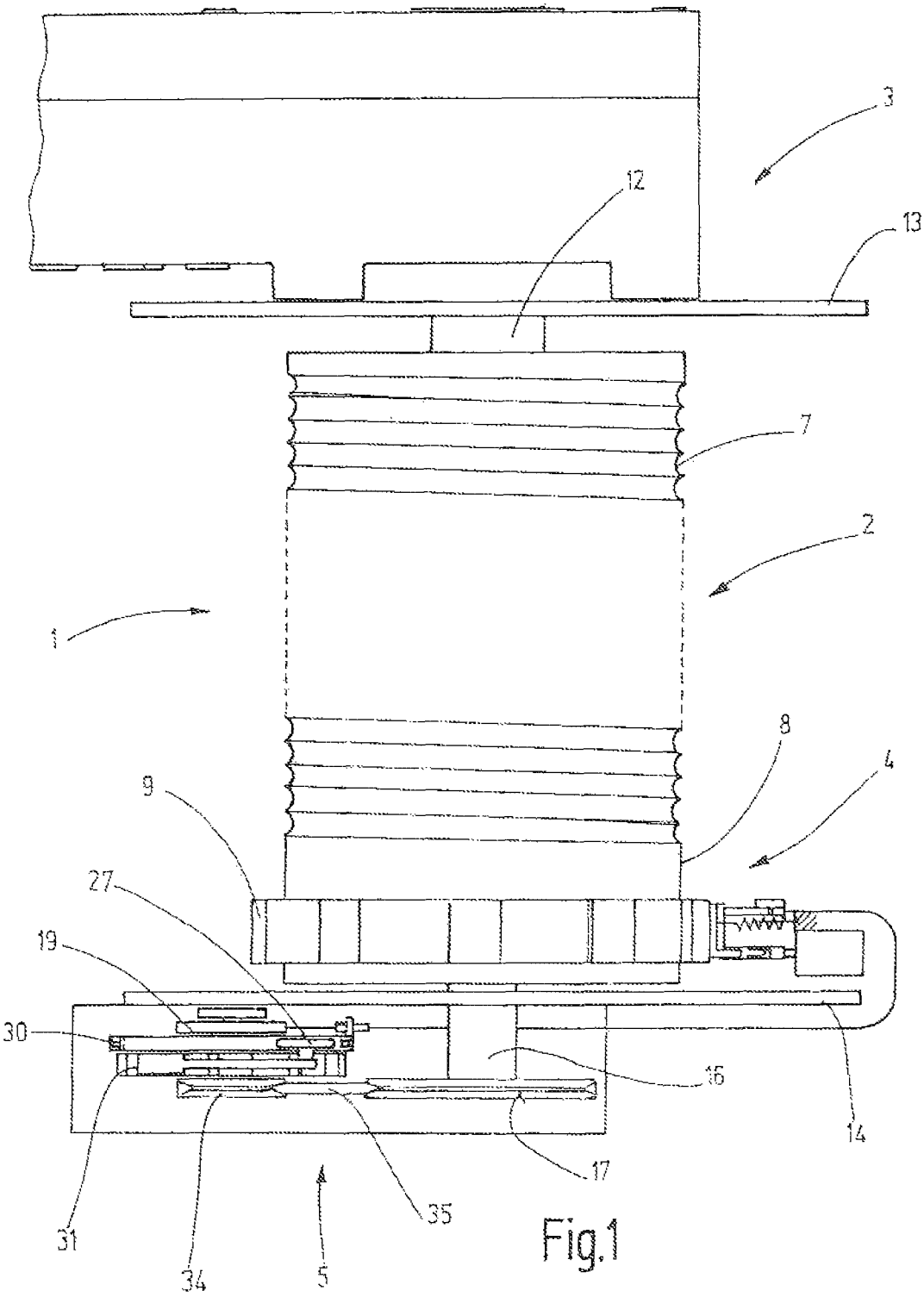
FIG. 1 is a schematic plan view of a cable hoist in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

The description of the figures hereinafter explains aspects for understanding the invention. Additional, not described details can be inferred by the person skilled in the art in the usual manner by referring to the drawings that supplement the description of the figures to this extent. It is obvious that a number of modifications are possible.

The drawings hereinafter are not necessarily true to scale. In order to illustrate details it is possible that certain areas are represented in an exaggeratedly large size. In addition, the drawings are simplified overviews and do not contain every detail that might potentially be present in the practical implementation. The terms "top" and "bottom" or "front" and "back" relate to the normal position of installation or to the terminology used for cable hoists.

DESCRIPTION OF THE PREFERRED EMBODIMENTS

Referring now more particularly to FIG. 1 of the drawings, there is shown an illustrative cable hoist 1 in accordance with the invention which comprises a cable drum 2, a drive in the form of a gear motor 3, an emergency braking arrangement 4, and a control device 5 for the emergency braking arrangements a manner known in the art, the cable drum 2 has cable grooves 7 upon which a cable can be wound in a conventional manner. While the cable is not shown for purposes of clarity, it would move off on the right-hand side of the cable drum 2 as viewed in FIG. 1.

On one end, the cable drum terminates in a cylindrical extension 8 that acts as the brake drum. Seated on the cylindrical extension 8 of the cable drum 2 is a brake shoe 9 that, is provided with saw teeth 11 on its outside, as is shown by the remaining figures. As will be understood, the brake shoe 9 is maintained in frictional contact with the cylindrical extension 8 at a prespecified pressure.

The cable drum 2 is driven via the gear motor 3 which has an output shaft 12.

End shields 13,14 provide support for the cable drum 2, together with the gear motor output shaft 12 at one end of the cable drum and a bearing shaft 16 at an opposite end of the cable drum. A V-belt pulley 17 is seated on the free end of the bearing shaft 16 and acts as a component of the drive of the control device 5.

Figure 2:
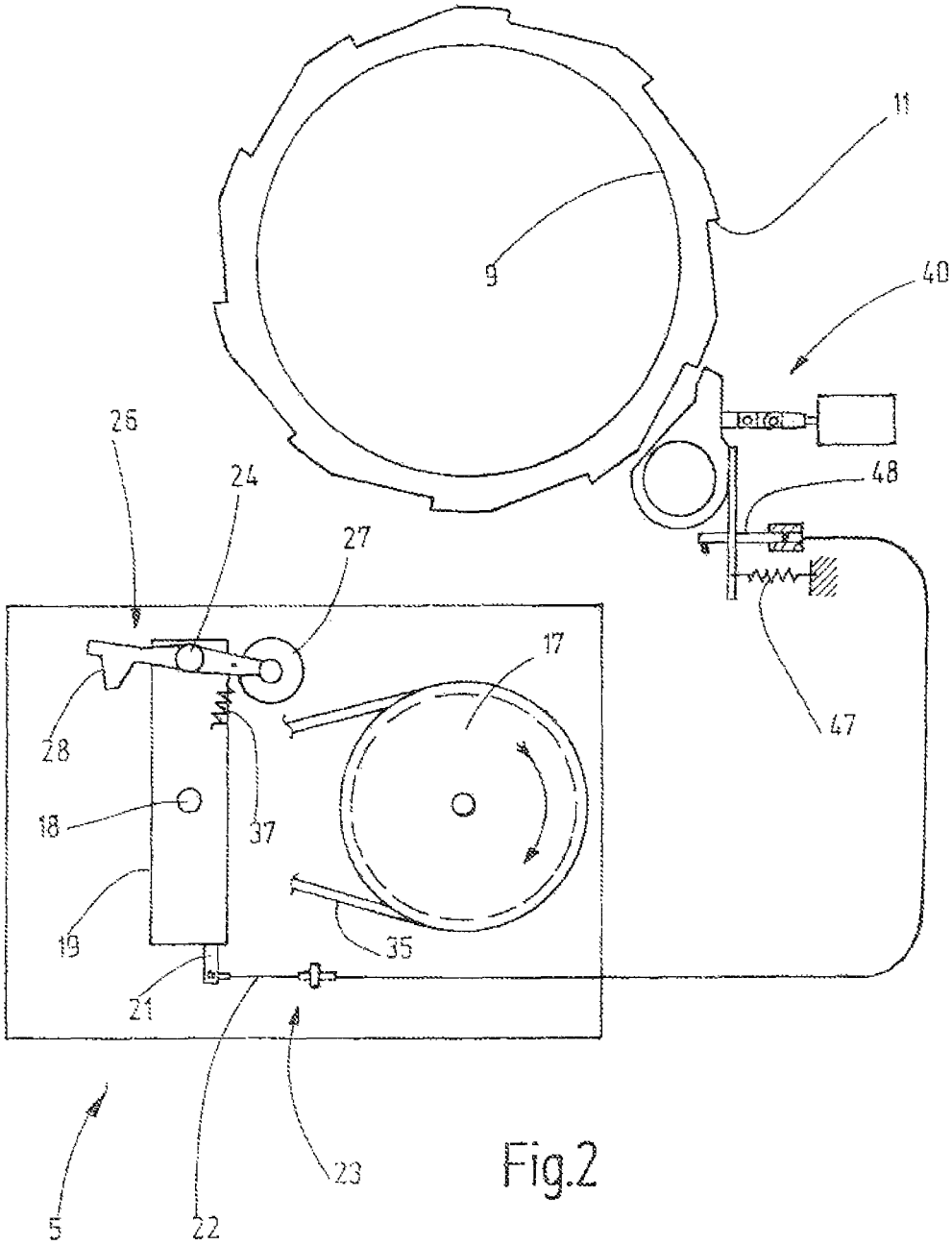
FIG. 2 is a side view of a control device of the illustrated cable hoist having a braking arrangement on the cable drum.
Figure 3:
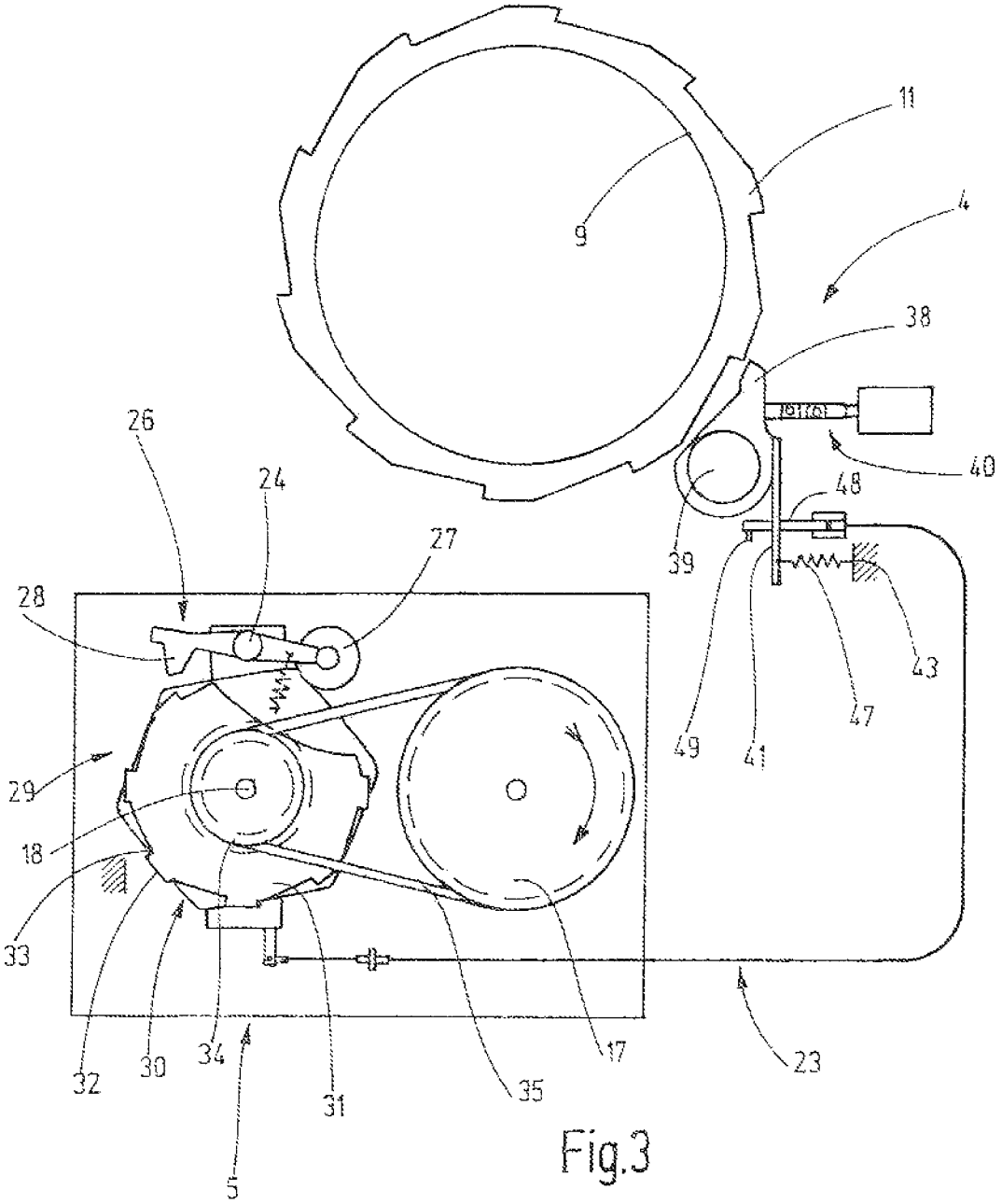
FIG. 3 is a side view of the control device prior triggering of the braking arrangement.

The control device 5, as best depicted in FIGS. 2 and 3, includes a bearing shaft or axle 18 fixedly seated on the end shield 14 in parallel relation with the cable drum 2. An anchor carrier 19 is supported on the shaft 18 so as to be able to pivot in a pendulum fashion. The anchor carrier 19 is designed as a two-arm lever. The lower end of said lever is connected with a core 22 of a Bowden cable 23. An anchor 26 is rotatably supported on the upper end of the anchor carrier 19 so as to be pivotable on a shaft 24 that is parallel to the anchor carrier shaft 18.

The anchor 26 is also a two-armed lever and supports, on its right end as viewed in FIG. 2, a sensing roller 27 that is oriented axis-parallel to the anchor shaft 24. On its opposite end, the anchor 26 is provided with an engaging pawl 28 that, as shown, is oriented downward or in the direction toward the bearing shaft 18.

As depicted in FIG. 3, a toothed wheel assembly 29 is seated next to the anchor carrier 19 on the axle 18. The toothed wheel assembly 29 is comprised of a driving or polygonal wheel 30 having a regular polygonal exterior form and a ratchet wheel 31. The driving wheel 30 has rounded vertices and straight surfaces extending therein between symmetrical to the axle 18 as shown.

As opposed to this, the ratchet wheel 31 is non-rotatably coupled to the driving wheel 30 and has teeth 32 having sharp-edged flanks 33. The flanks 33 are disposed to interlockingly engage a corresponding surface of the engaging pawl 28.

In order to impart movement to the anchor 26 in pendulum fashion the sensing roller 27 interacts with the outer circumferential surface of the driving wheel 30. The toothed wheel assembly 29 is rotatable via a V-belt pulley 34 non-rotatably connected to the toothed wheel assembly 29. The diameter of the V-belt pulley 34 is smaller than the diameter of the V-belt pulley 17 so that the V-belt pulley 34 is driven by a V-belt 35 at a rotational speed that is greater than the rotational speed of the cable drum 2.

The control device 5 comprises an additional tension spring 37 between the anchor 26 and the anchor carrier 19 for holding the sensing roller 27 in abutting rotation against the outer circumferential surface of the driving toothed wheel 30.

The Bowden cable 23 establishes the mechanical connection between the control device 5 and the emergency braking arrangement 4. The emergency braking arrangement 4 comprises a pawl 38 that is pivotally supported on a shaft 39 parallel to the axis of the cable drum. The free end of the pawl 38 is disposed to interact with the steep flank of the teeth 11. With the use of a magnet arrangement including a magnet 40 as shown, the pawl 38 is held out of engagement with the brake shoe 9. Together with the teeth 11, the pawl 38 forms a type of actuating/triggering mechanism of the emergency braking arrangement 4.

A lever 41 contacts the pawl 38 with the aid of a tension spring 47 which urges the pawl 38 into the engagement with the teeth 11 of the brake shoe 9.

A slider 48 with a dog 49 comes into contact with the lever 41 via the core 22.

It will be understood that instead of the magnet 40 in conjunction with the tension spring 47, the use of only one spring that holds the pawl 38 out of engagement with the teeth 11 could also be used.

The described arrangement works as follows:

In normal mode, a supply voltage is applied to the cable hoist, thus causing the magnet 40 to hold the locking pawl 38 out of engagement with the teeth of the brake show 9 against the action of the tension spring 47. In doing so, the gear motor 3 can rotate the cable drum 2 as desired in both directions, i.e., in the direction of a lifting of the load as well as in the direction of a lowering of the load.

When the gear motor 3 starts to rotate the cable drum 2, this rotary motion is transmitted via the V-belt pulley 17 to the V-belt 35 and to the V-belt pulley 34 and thus also to the toothed wheel assembly 29. The rotary motion is relatively slow, and the sensing roller 27 of the anchor 26 is able to follow the contour of the driving toothed wheel 30. Also, the anchor 29 does not lift off the driving toothed wheel 30 at the vertices of the polygonal form. Other than that, the arrangement is such that, when the sensing roller 27 moves over a vertex of the polygonal form, the tip of the pawl 28 is still at a distance from the shaft 18 such that the teeth 32 of the ratchet wheel 31 cannot come into engagement with the pawl 28.

With the cable drum in normal rotational movement mode, the anchor 26 performs a more or less slow pitching movement about the shaft 24.

Should there be a malfunction or error causing the driving motor 3 to no longer be able to accept the torque, torque originating from a load suspended from the cable, while, at the same time the electromagnet 40 holds the pawl 38 out of engagement with the brake shoe 9, the control device 5 will be actuated. In that case, a crashing load rotates the cable drum 2 in clockwise direction.

Inasmuch as the driving motor 3 can no longer hold the load, the load will tend to crash and, in doing so, substantially increase the rotational speed of the cable drum 2. Correspondingly, the rotational speed of the toothed wheel assembly 29 will also increase. The increasing rotational speed causes the sensing roller as it is moving along the straight edges in the direction of the vertex of the polygonal hoist to be accelerated in radially outward direction at such a velocity that said sensing roller will ultimately lift off the outer circumferential surface of the driving wheel 30 in the area of the vertexes. When, as a result of a continually increasing speed, the amplitude has become large enough, the pawl 28 will move closely enough in the direction of the shaft 18 that the pawl 28 will enter the gap between two detent teeth 32. In that event, the steep flank 33 of the pawl 28 moves against the corresponding steep flank of the pawl 28 and locks the anchor 26 in this engagement position. Thus, rotational movement between the toothed wheel assembly 29 and the anchor carrier 19 is thereupon blocked.

Figure 4:
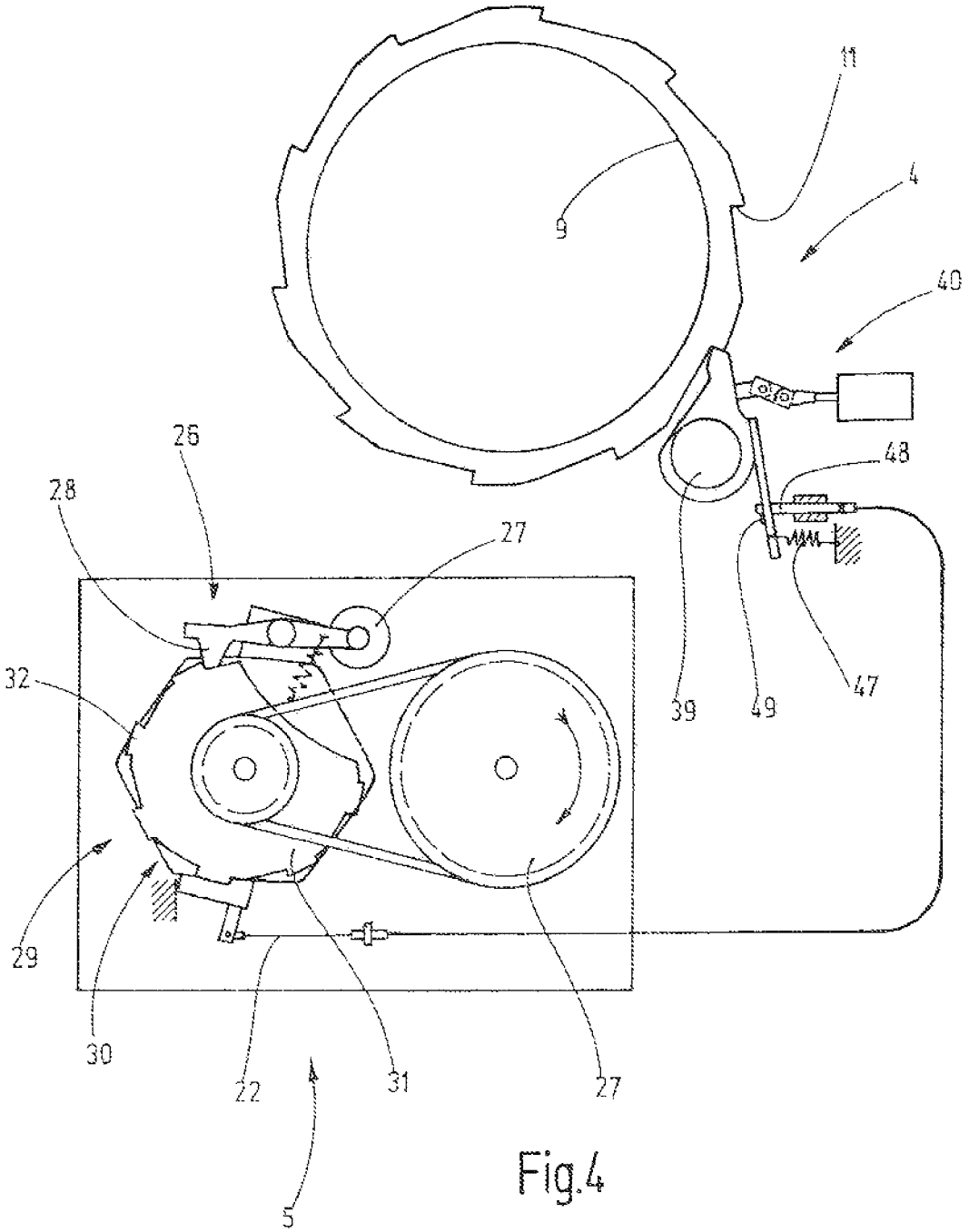
FIG. 4 is a side view of the control device after triggering of the braking arrangement.

Since the toothed wheel assembly 29 is driven via the V-belt 35—i.e., in the assumed example in clockwise direction—the interlocking of the ratchet wheel 31 with the anchor 26 causes the anchor carrier 19 to also be rotated by a certain distance in clockwise direction about the shaft 18, as is shown by FIG. 4. In doing so, its lower arm 23 pulls on the core 22 of the Bowden cable 23, this, in turn, having the effect that the dog 49 comes into engagement with the arm 41 and pivots the arm 41 in counterclockwise direction relative to the shaft 39. As a result of this, the pawl 38 is rotated against the action of the holding magnet 40, and the tip or dog of the pawl 38 can come into engagement with the detent teeth 11. As soon as the pawl 38 has come into engagement with one of the teeth 13 the brake shoe 9 is held in place and can no longer rotate with the cable drum 2. The frictional action between the brake shoe 9 and the cable drum 2 becomes effective, and the cable drum 2 can be braked to a stop.

Damage of the arrangement is prevented because the V-belt 35 runs appropriately loosely so that, on the one hand, the belt is able to input the necessary torque to the V-belt pulley necessary to enable the anchor carrier 19 to move the pawl 38 against the action of the holding electromagnet 40. On the other hand, the bias is small enough to enable the V-belt to act on the V-belt pulleys 17 and 34 in the manner of a slip friction clutch. While not shown for purposes of clarity of the foregoing operation, it will be understood that an appropriate belt tightener may be used.

With the use of the bias spring 37 in conjunction with the moment of inertia of the anchor 26 it is possible to achieve a balance that ensures that the pawl 28 of the anchor 26 will safely engage in the gap between the teeth 32, only when an appropriate overspeed of the cable drum has been reached. The spring 37 ensures that small pulses caused by the passing motion of one vertex of the driving toothed wheel 30 do not cause an interlocking between the anchor 26 and the driving toothed wheel 31.

It will be understood, that the emergency braking arrangement in accordance with the invention does not require any additional outside energy supply. The braking arrangement uses only the kinematic and potential energy inherent in the moving load on the hook.

Consequently, the system also works faultlessly even if there should be an outage of supply voltage or a failure of the control for the gear motor 3.

From the foregoing, a cable hoist is provided which has an improved emergency braking arrangement. The emergency braking arrangement comprises a toothed wheel assembly that is driven via the cable drum. One of two toothed wheels is sensed by a sensing lever of an anchor, and the other end of the anchor interacts with a ratchet wheel of the toothed wheel assembly. As soon as an overspeed occurs, the anchor engages in the ratchet wheel and causes a rotary movement of the carrier on which the anchor is seated. This rotary motion is used to trigger a mechanical braking arrangement coupled to the cable drum.

The invention claimed is:

1. A cable hoist comprising:

a rotatably supported cable drum;

a drive for rotating the cable drum;

a braking arrangement for braking rotary movement of the cable drum, said braking arrangement including a triggering mechanism and a control device;

said control device including a toothed wheel assembly supported on an axle rotatably driven by rotation of the cable drum, said tooth wheel assembly including a driving wheel having radial extensions and a ratchet wheel having teeth;

an anchor carrier support on said axle for pivotal movement;

an anchor supported on said anchor carrier having a pawl at one end for interacting with the ratchet wheel and a sensing member at an opposite end for interacting with the driving wheel; and a clutch assembly arranged between the anchor carrier and the triggering mechanism for transmitting a pivoting notion of the anchor carrier to the triggering mechanism.

2. The cable hoist of claim 1 in which said driving wheel has a polygonal outside circumferential form.

3. The cable hoist of claim 1 in which said clinch assembly is a slip friction clutch assembly operatively arranged between said driving wheel and said cable drum.

4. The cable hoist of claim 1 including a belt assembly for driving the driving wheel, said belt assembly comprising a pulley non-rotatably coupled to the cable drum and a belt for driving the driving wheel as an incident to rotation of the pulley.

5. The cable hoist of claim 4 in which said belt assembly rotates the driving wheel at a greater rotational speed than the rotational speed of the cable drum.

6. The cable hoist of claim 4, including a belt tensioning arrangement associated with the belt.

7. The cable hoist of claim 1 in which said anchor has an associated spring that biases the anchor in a position in which the pawl of the anchor is out of engagement with the ratchet wheel.

8. The cable hoist of claim 7 in which said spring and anchor interact such that during rotation of the cable drum the anchor follows a contour of the driving wheel without over lifting.

9. The cable hoist of claim 1 in which said sensing member includes a sensing roller rotatably supported on the anchor.

10. The cable hoist of claim 1 in which during rotational speed of the cable drum, the anchor remains in engagement with the driving wheel.

11. The cable hoist of claim 1 in which the clutch assembly includes a Bowden cable.

12. The cable hoist of claim 1 in which the braking arrangement includes a brake drum non-rotatably coupled to the cable drum, and said brake drum including at least one brake shoe.

13. The cable hoist of claim 12 in which the braking arrangement includes a detent device for locking the at least one brake shoe in place.

* * * * *